US006481578B2

(12) United States Patent
Hsu

(10) Patent No.: US 6,481,578 B2
(45) Date of Patent: Nov. 19, 2002

(54) CARTON FOR NOTEBOOK COMPUTERS AND PULP INSERTS FOR USE THEREIN AND COMBINATION THEREOF

(75) Inventor: Fong-Ling Hsu, Taoyuan Hsien (TW)

(73) Assignee: Quanta Computer, Inc. (TW)

( * ) Notice: Subject to any disclaimer, the term of this patent is extended or adjusted under 35 U.S.C. 154(b) by 0 days.

(21) Appl. No.: 09/780,965

(22) Filed: Feb. 9, 2001

(65) Prior Publication Data

US 2002/0148744 A1 Oct. 17, 2002

(51) Int. Cl.[7] ..... B65D 81/113; B65D 8/133

(52) U.S. Cl. ..... 206/589; 206/564; 206/320; 229/120.38

(58) Field of Search ..... 206/320, 564, 206/589; 229/120.32, 120.38

(56) References Cited

U.S. PATENT DOCUMENTS 3,165,200 A * 1/1965 Hanson ..... 206/362.1
3,682,597 A * 8/1972 Husch ..... 206/446
4,194,678 A * 3/1980 Jasper ..... 206/427
5,004,102 A * 4/1991 Timmins et al. ..... 206/319
5,573,117 A * 11/1996 Adams ..... 206/449
5,823,424 A * 10/1998 Allen ..... 206/565
6,142,440 A * 11/2000 Gratz et al. ..... 108/51.11

* cited by examiner

*Primary Examiner*—David T. Fidei
(74) *Attorney, Agent, or Firm*—Perkins Coie LLP

(57) ABSTRACT

A carton for packaging a plurality of substantially identical notebook computers having sides and bottoms. The carton comprises first and second parallel spaced-apart side walls, first and second parallel spaced-apart end walls adjoining the first and the second side walls to form a four-sided enclosure, and spaced-apart parallel top and bottom closures adjoining the four-sided enclosure to provide a six-sided enclosed space. Moreover, the carton comprises a first insert disposed in the enclosed space and extending substantially continuously over the bottom closure and being supported by the bottom closure. The notebook computers are disposed within the six-sided enclosed space and engaging the first insert. Furthermore, the carton comprises a second insert disposed in the enclosed space. The second insert has a plurality of elongated holes each respectively surrounding each of the notebook computers by partially engaging the sides thereof, so that the notebook computers are retained in parallel spaced-apart positions out of engagement with each other and in parallel spaced-apart positions with respect to the end walls during movement of the carton with the notebook computers therein.

12 Claims, 5 Drawing Sheets

CARTON FOR NOTEBOOK COMPUTERS AND PULP INSERTS FOR USE THEREIN AND COMBINATION THEREOF

FIELD OF THE INVENTION

This invention relates to a carton for packaging notebook computers. Moreover, this invention relates to a carton for notebook computers and pulp inserts for use therewith and a combination thereof.

BACKGROUND OF THE INVENTION

Cartons are conventionally provided for packaging a plurality of notebook computers. The use of such conventional cartons has a number of disadvantages. For example, the breakdown of the packaged computers occurs because of the computers contacting with each other during transportation of the carton from one location to another. There is therefore a need for a new and improved carton which overcomes these disadvantages.

SUMMARY OF THE INVENTION

It is an object of the present invention to provide a carton for notebook computers which prevents the notebook computers from being contacted with each other during transportation of the carton from one location to another.

Another object of the invention is to provide a carton which has inserts therein which engage the bases of the notebook computers and the sides of the thereof to maintain spacing between the notebook computers, so that the notebook computers do not come in contact with each other or with the carton, and thereby preventing breakdown of the notebook computers.

Additional objects and features of the invention will appear from the following description in which the preferred embodiments are set forth in detail in conjunction with the accompanying drawings.

A carton for packaging a plurality of substantially identical notebook computers having sides and bottoms is described. The carton comprises first and second parallel spaced-apart side walls, first and second parallel spaced-apart end walls adjoining the first and the second side walls to form a four-sided enclosure, and spaced-apart parallel top and bottom closures adjoining the four-sided enclosure to provide a six-sided enclosed space. The carton further comprises a first insert disposed in the enclosed space and extending substantially continuously over the bottom closure and being supported by the bottom closure, wherein the notebook computers is disposed within the six-sided enclosed space and engaging the first insert. Moreover, the carton comprises a second insert, disposed in the enclosed space, the second insert having a plurality of elongated holes each respectively surrounding each of the notebook computers by partially engaging the sides thereof, so that the notebook computers are retained in parallel spaced-apart positions out of engagement with each other and in parallel spaced-apart positions with respect to the end walls during movement of the carton with the notebook computers therein.

DETAILED DESCRIPTION OF THE PREFERRED EMBODIMENT

Figure 1:
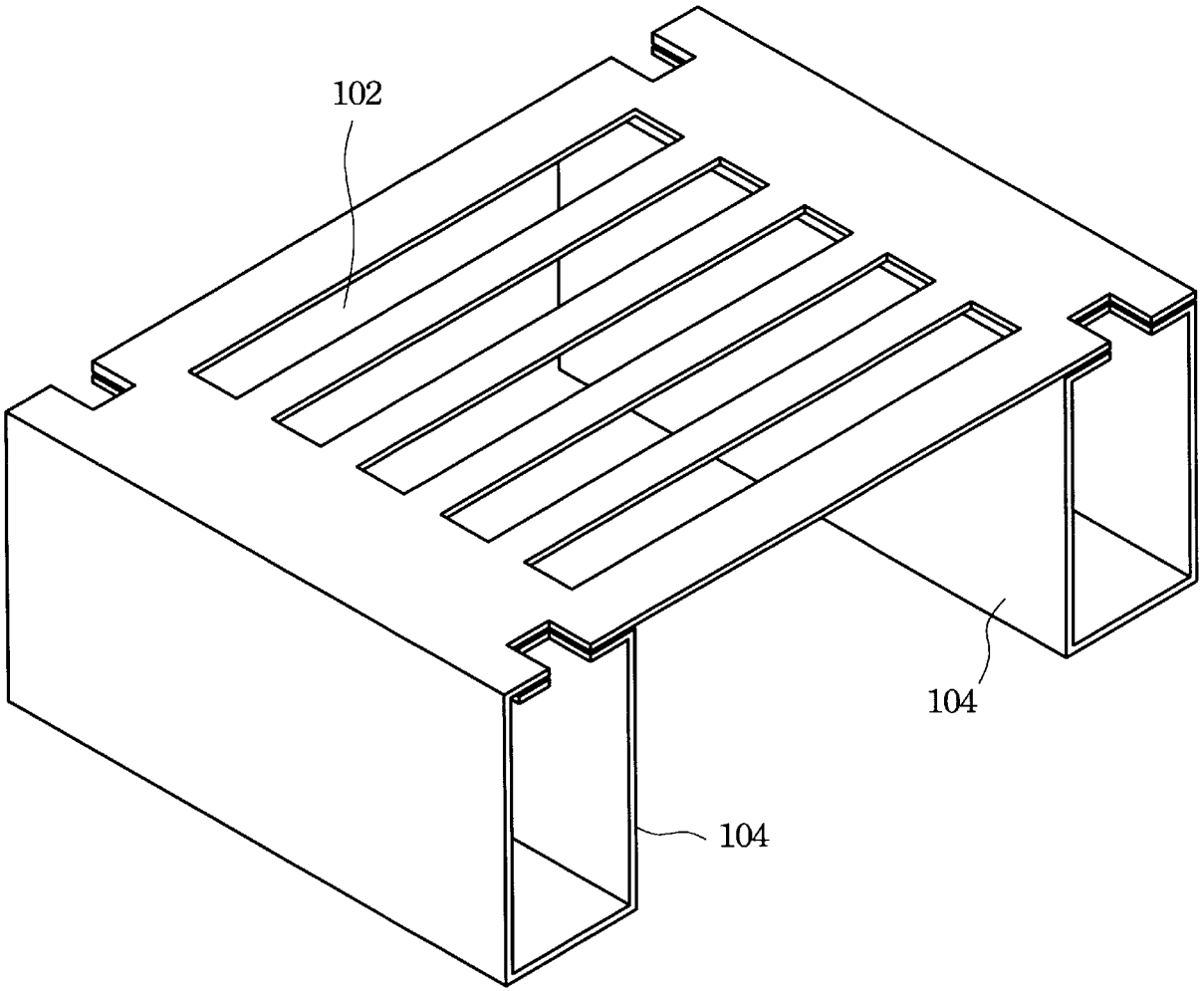
FIG. 1 is a view schematically showing a partition according to a preferred embodiment of the present invention.

FIG. 1 schematically s hows a partition according to a preferred embodiment of the present invention. The partition, formed of, for example, a molded pulp, is for use in packaging a plurality of substantially identical notebook computers. The partition, also for use in a carton, comprises a frame having a plurality of substantially-parallel elongated holes 102 each respectively surrounding each of the notebook computers.

Figure 2:
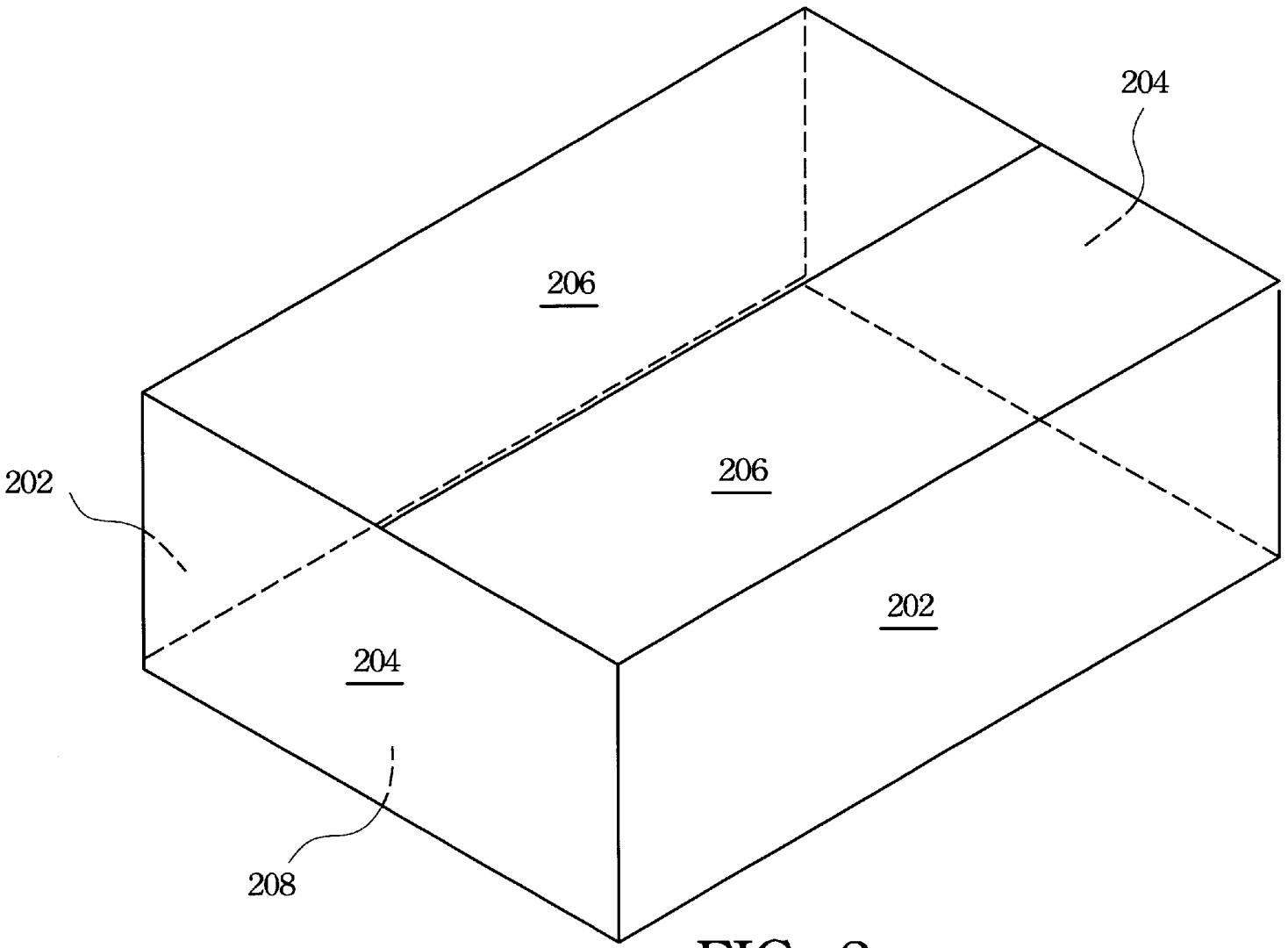
FIG. 2 is a view schematically showing a carton comprising first and second parallel spaced-apart side walls, first and second parallel spaced-apart end walls.

Referring to FIG. 2, the carton comprises first and second parallel spaced-apart side walls 202, first and second parallel spaced-apart end walls 204 adjoining fie first and the second side walls 202 to form a four-sided enclosure. Moreover, the carton further comprises spaced-apart parallel top and bottom closures 206 and 208 adjoining the four-sided enclosure to provide a six-sided enclosed space. The carton, hating the invented partition (FIG 1), has been drop tested to ensure that the packaged notebook computers could be transported without breakdown. As a matter of fact, without the partition, a carton could not pass a drop test.

In a drop test for five notebook computers in one package, the carton is dropped to rigid surface (such as concrete, stone or steel plate) from about 100 cm height for one corner, three edges and six faces. The purpose of this test is to verify the package can withstand the drop test during the transportation environment. The following is some of the test report:

| Hardware Configuration: | |
|---|---|
| 1. CPU | :Intel PIII 650 MHz uPGA2/Celeron 550 MHz. |
| 2. Core System | :82443ZX AGP set. |
| 3. L2 Cache | :256K PBSRAM on die. |
| 4. System Memory | :64MB SDRAM on board. |
| 5. BIOS | :SST 28SF040. |
| 6. Audio Controller | :ESS ES1988S. |
| 7. Keyboard Controller | :NS PC87570 |
| 8. VGA Controller | :ATI RAGE Mobility-M. |
| 9. Display Memory | :4MB |
| 10. LCD | :Sharp 14.1"TFT XGA LVDS, Low reflection Black TFT. |
| 11. I/O Controller | :NS PC97338 |
| 12. PCMCIA Controller | :TI PC14451 |
| 13. CD-RW | :Panasonic UJDA 320. |
| 14. HDD | :TOSHIBA MK1016G AP |
| 15. FDD | :PANASONIC JU-226A142FC. |
| 16. Touch Pad | :Two click buttons, Synaptics. |
| 17. USB | :fw82371MB. |

Test

Amidiag program after drop test

TABLE I

| (Test Result) | | |
|---|---|---|
| Edge Seq.\S/N | G Value | Result |
| 1. Corner 1 | — | Passed |
| 2. Edge 1 | — | Passed |

TABLE I-continued

| Edge Seq.\S/N | (Test Result) G Value | Result |
|---|---|---|
| 3. Edge 2 | — | Passed |
| 4. Edge 3 | — | Passed |
| 5. Face 1 | 35.23 G | Passed |
| 6. Face 2 | 28.54 G | Passed |
| 7. Face 3 | 20.7 G | Passed |
| 8. Face 4 | 43.9 G | Passed |
| 9. Face 5 | 33.7 G | Passed |
| 10. Face 6 | 26.8 G | Passed |

Table 1 shows that the appearance and mechanical structure are good and occur no error.

Referring to Table I, the "-" shown in the table indicates that the edge test or the corner test are performed without consideration of G values. Usually, whether such test results are passed or not depends on the level of damage. The G values shown in the table indicate the drop tolerance for the faces of the carton. Under those values, the carton could be transported without breakdown of the notebook computers.

Turning to FIG. 1, in using the partition, the notebook computers are vertically inserted through the holes 102 of the partition. Under the notebook computers, a molded tray 302 (FIG. 3) is disposed in the enclosed space of the carton. The molded tray 302, being supported by the bottom closure, extends substantially continuously over the bottom closure for being engaged by the notebook computers.

Additionally, the partition 102 (FIG. 1), partially engaging the notebook computers, stores the notebook computers in parallel spaced-apart positions out of engagement with each other and in parallel spaced-apart positions with respect to the first and second spaced-apart parallel end walls 202 (FIG. 2) during movement of the carton with the notebook computers therein. Furthermore, referring to FIG. 1, the partition is formed with two shockproof sidewalls 104 for preventing engagement of the notebook computers with respect to the first and second side walls 204 (FIG. 2). The two shockproof sidewalls 104 are formed vertically with the frame 110 having fist faces 108 and second faces 106, wherein the fist faces 108 are adjacent to the first and second side walls 204 and the second faces 106 are adjacent to the sides of the notebook computers The shockproof sidewall 104 is formed with enough space between the first face 108 and the second face 106 to withstand the drop shock in a drop test without the shockproof sidewalls 104, the first and second side walls 204 may be broken after the drop test is performed. One skilled in the art would be able to calculate the space needed between the first and second faces depending on variables such as weight.

Generally, a carton has a limitation of carrying capacity. The limitation is because that the carton is conventionally transported on stand boards for freight transportation, and the stand boards for freight transportation are usually have their own specific standardization. Under this limitation, a carton could package, for example, but not limited to, four to six notebook computers according to a preferred embodiment of the present invention. In this case, the partition is correspondingly formed with four to six holes, respectively. More preferably, a carton is for packaging five notebook computers, while the partition is formed with five holes. It is noted that a carton packaging excess notebook computers may not pass a drop test. However, more notebook computers could be packaged in a carton if the notebook computers are designed to be thinner and lighter.

Figure 4:
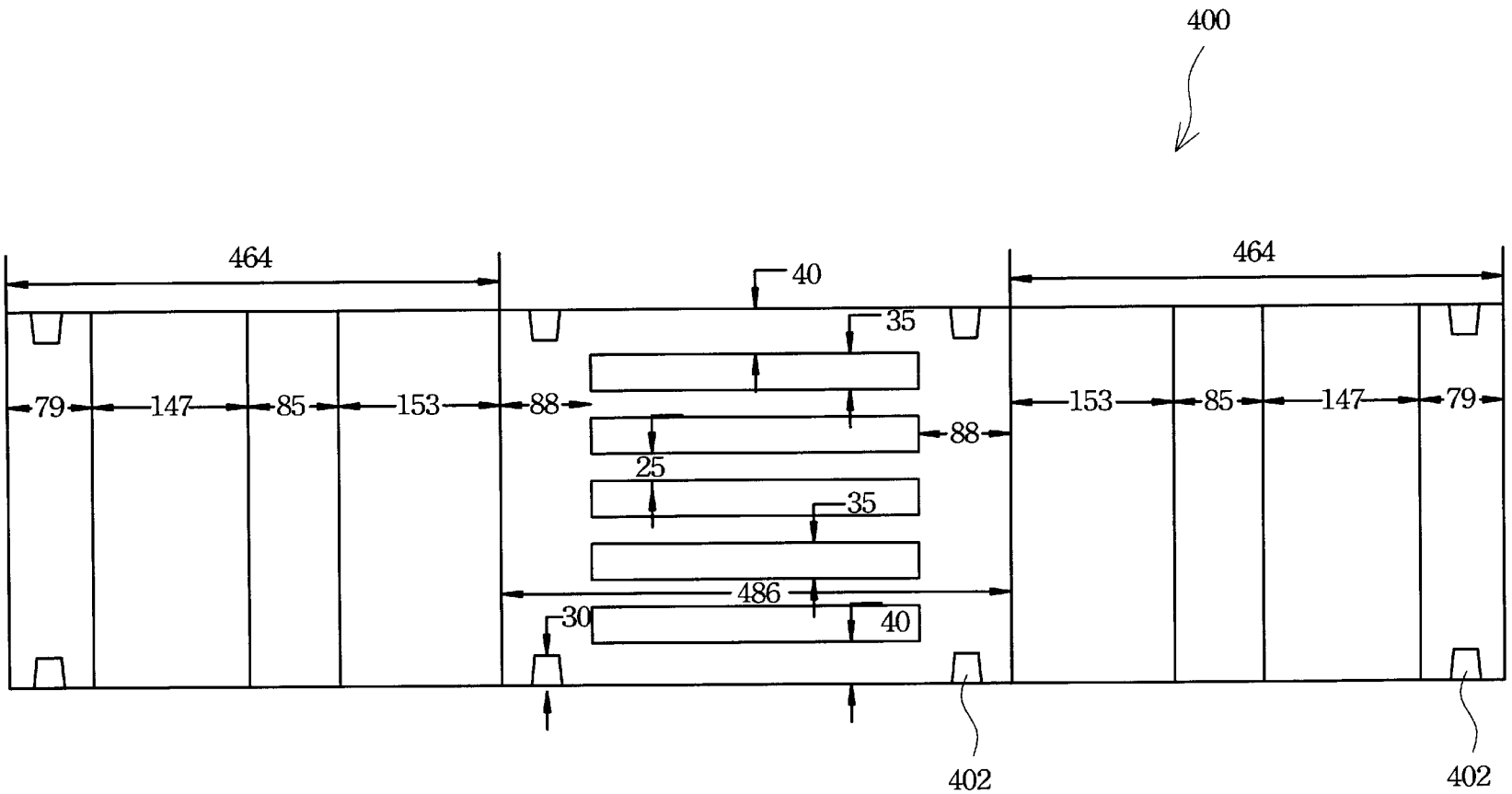
FIG. 4 is a plan view of a five-in-one-package unfolded partition.
Figure 5:
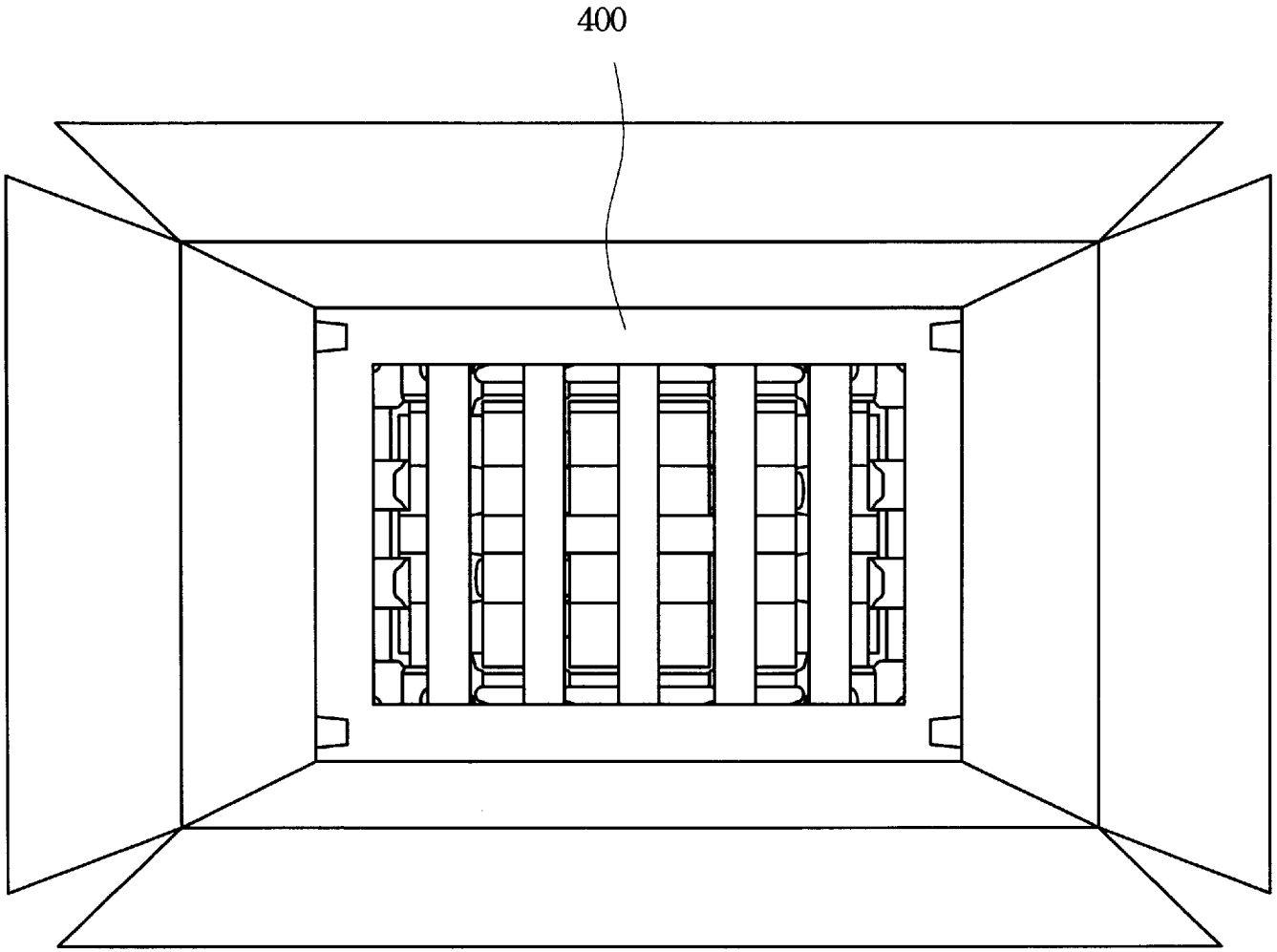
FIG. 5 is a top plan view of a partition disposed on a molded tray supported by the bottom closure of a carton.

FIG. 4 schematically shows a plane designation for a five-in-one-package unfolded partition. In the figure, the numbers are some suggested sizes in unit of millimeter. It is note that the partition 400 has the ladder-shaped members 402 serving as fasteners. The partition 400 is disposed on a molded tray supported by the bottom closure of the carton, as shown in FIG. 5.

Figure 3:
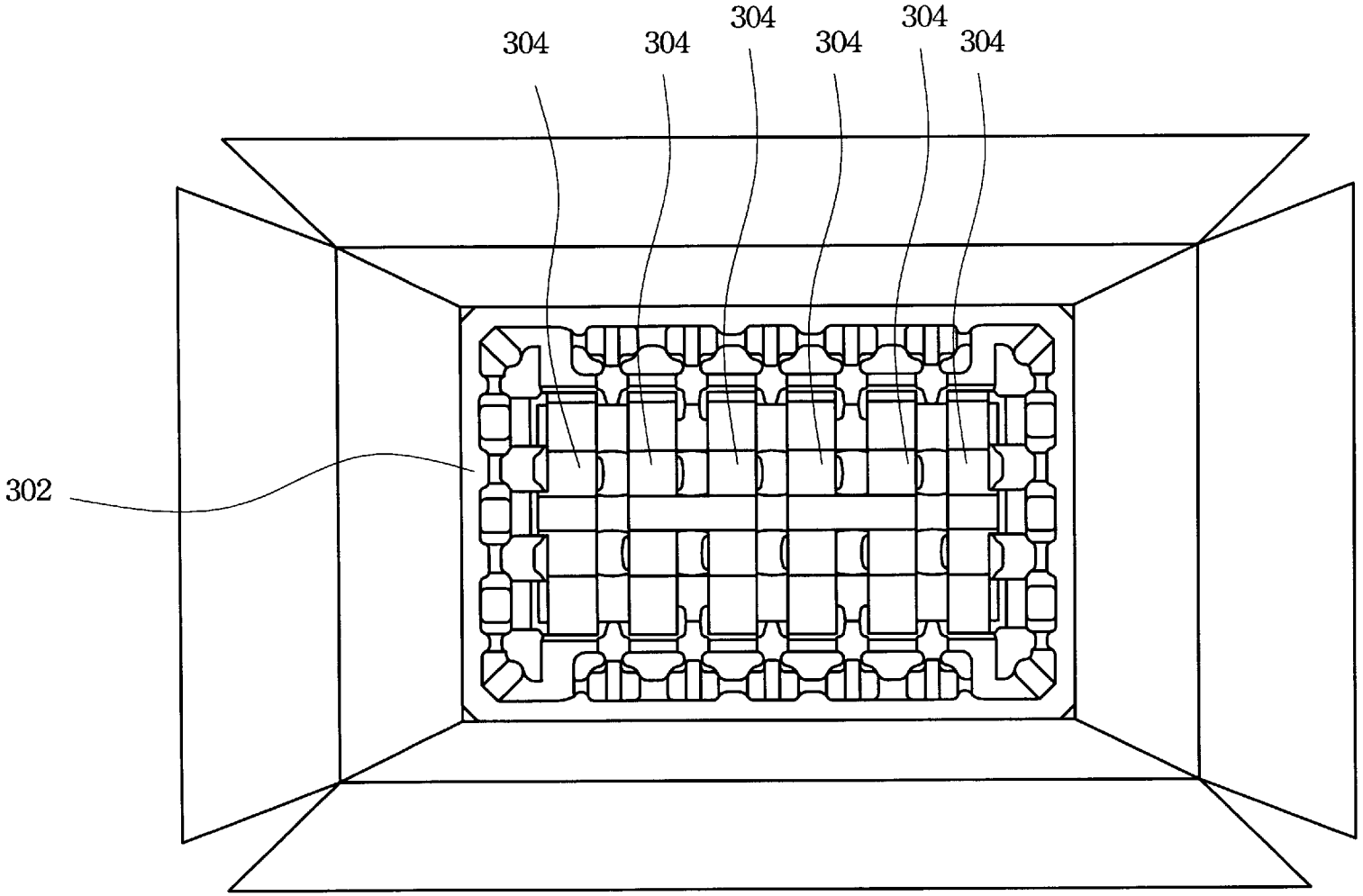
FIG. 3 is a top plan view of a molded tray of a carton.

FIG. 3 is a top view schematically showing a molded tray 302 of a carton. Referring to FIG. 3, the molded tray 302 comprises a substantially planar sheet of material having a plurality of wells 304 formed therein for receiving the bottoms and a portion of the sides of the notebook computers. The wells 302 are substantially parallel spaced-apart. Preferably, the sheet of material is a molded pulp.

The present invention has the following advantages:

1. The partition and the molded tray prevent the notebook computers from being contacted with each other during transportation of the carton from one location to another.

2. The partition and the molded tray engage the bases of the notebook computers and the sides of the thereof to maintain spacing between the notebook computers, so that the notebook computers do not come in contact with each other or with the carton, and thereby preventing breakdown of the notebook computers.

Although the invention has been described in detail herein with reference to its preferred embodiment, it is to be understood that this description is by way of example only, and is not to be construed in a limiting sense. It is to be further understood that numerous changes in the details of the embodiments of the invention, and additional embodiments of the invention, will be apparent to, and may be made by, persons of ordinary skill in the art having reference to this description. It is contemplated that such changes and additional embodiments are within the spirit and true scope of the invention as claimed below.

What is claimed is:

1. A carton for storing a plurality of substantially identical notebook computers having sides and bottoms, the carton comprising:

first and second parallel space-apart side walls;

first and second parallel spaced-apart end walls adjoining the fast and the second side walls to form a four-sided enclosure;

spaced-apart parallel top and bottom closures adjoining the four-sided enclosure to provide a six-sided enclosed space;

a first insert disposed in the enclosed space and extending substantially continuously over the bottom closure and being supported by the bottom close the notebook computers being stored within the six-sided enclosed space and engaging the first insert; and a second insert disposed in the enclosed space, the second insert having a plurality of elongated holes each respectively surrounding each of the notebook computers by partially engaging the sides thereof so that the notebook computes are retained in parallel spaced-apart positions out of engagement with each other and in parallel spaced-apart positions with respect to the end walls during movement of the carton with the notebook computers therein, wherein the second insert further comprises two shockproof sidewalls for preventing engagement of the notebook computers with respect to the side walls and the two shockproof sidewalls have first faces adjacent to the side walls and second faces adjacent to the sides of the notebook computers.

2. The carton as in claim 1, wherein the second insert is formed of a molded pulp.

3. The carton as in claim 1, further comprising a substantially planar sheet of material having a plurality of wells formed therein for receiving the bottoms and a portion of the sides of the notebook computers.

4. The carton as in claim 3, wherein the wells are substantially parallel spaced-apart.

5. The carton as in claim 1, wherein the first insert is formed of a molded pulp.

6. The carton as in claim 1, wherein the number of the notebook computers is four to six.

7. The carton as in claim 6, wherein the number of the notebook computers is five.

8. An insert for use in storing a plurality of substantially identical notebook computers having sides, and for use in a six-sided canon having first and second spaced-apart parallel side walls, first and second spaced-apart parallel end walls, and spaced-apart parallel top and bottom closures, the insert comprising;

a frame formed of a molded pulp having a plurality of substantially-parallel elongated holes each respectively surrounding each of the notebook computers by partially engaging the sides thereof for storing the notebook computers in parallel spaced-apart positions out of engagement with each other and in parallel spaced-apart positions with respect to the first and second spaced-apart parallel end walls during movement of the carton with the notebook computers therein; and two shockproof sidewalls formed vertically with the frame for preventing engagement of the notebook computers with respect to the fist and second side walls, wherein the two shockproof sidewalls have first faces adjacent to the side walls and second aces adjacent to the sides of the notebook computers.

9. The carton as in claim 1, wherein the shockproof sidewalls are formed with enough space between the first face and the second face to withstand a drop shock of over 20 G during a drop test.

10. The carton as in claim 1, wherein the shockproof sidewall further comprises a ladder-shaped fastener.

11. The insert as in claim 8, wherein the shockproof sidewlls are formed with enough space between the first face and the second face to withstand a drop shock of over 20 G during a drop test.

12. The insert as in claim 8, wherein the shockproof sidewall further comprises a ladder-shaped fastener.

* * * * *